United States Patent [19]

Faust

[11] Patent Number: 4,836,591

[45] Date of Patent: Jun. 6, 1989

[54] ANTI-THEFT VEHICLE HOOD LOCK RELEASE BLOCKER MECHANISM

[75] Inventor: James H. Faust, Hoffman Estates, Ill.

[73] Assignee: ABC Auto Alarms, Inc., Elk Grove Village, Ill.

[21] Appl. No.: 173,073

[22] Filed: Mar. 25, 1988

Related U.S. Application Data

[63] Continuation-in-part of Ser. No. 37,210, Apr. 10, 1987, Pat. No. 4,752,092.

[51] Int. Cl.[4] ..... E05C 9/10

[52] U.S. Cl. ..... 292/336.3; 292/DIG. 14; 292/125; 292/201

[58] Field of Search ..... 292/125, 133, 141, 171, 292/221, 225, 235, 336.3, DIG. 14, 28, 50, 125, 144, 201, 216, DIG. 25

[56] References Cited

U.S. PATENT DOCUMENTS 3,384,405 5/1968 Schiele ..... 292/216

4,752,092 6/1988 Faust ..... 292/201 X

*Primary Examiner*—Richard E. Moore

*Attorney, Agent, or Firm*—Silverman, Cass, Singer & Winburn, Ltd.

[57] ABSTRACT

An anti-theft hood lock release blocker assembly for preventing the release of a vehicle hood latch activated by a connecting sheathed cable. A bared portion of the cable is secured by a cable connector matingly engaged to a protruding member of a platform jounaled for rotation along a limited arc required to effect release of the hood latch. A remotely controlled electromagnetically operated lever is provided for interfering with the rotation of the platform the full length of the limited arc to prevent release of the hood latch. The assembly is provided with cable clamping apparatus to facilitate the retrofit installation of the assembly into existing hood latch/cable mechanisms.

20 Claims, 2 Drawing Sheets

FIG. 1
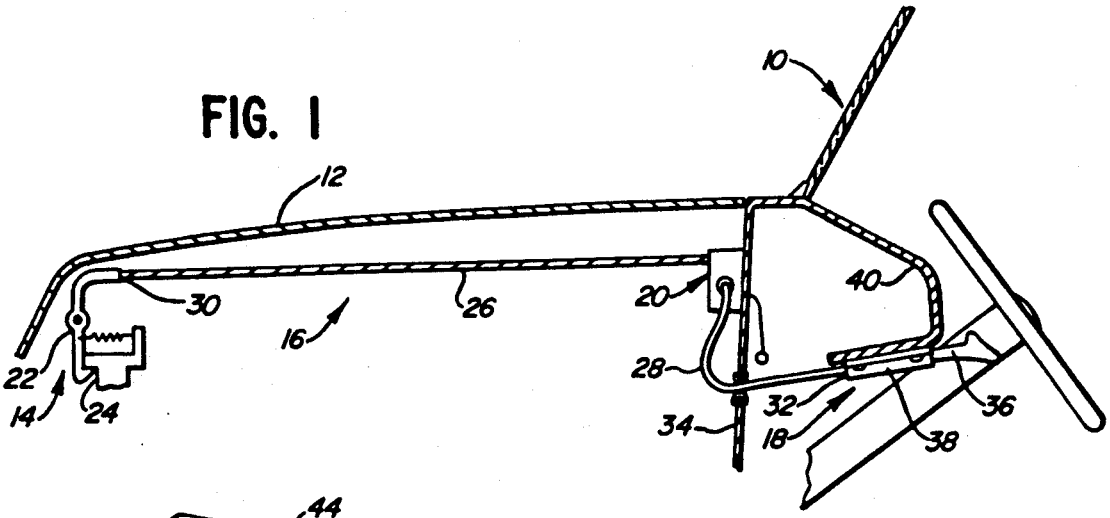
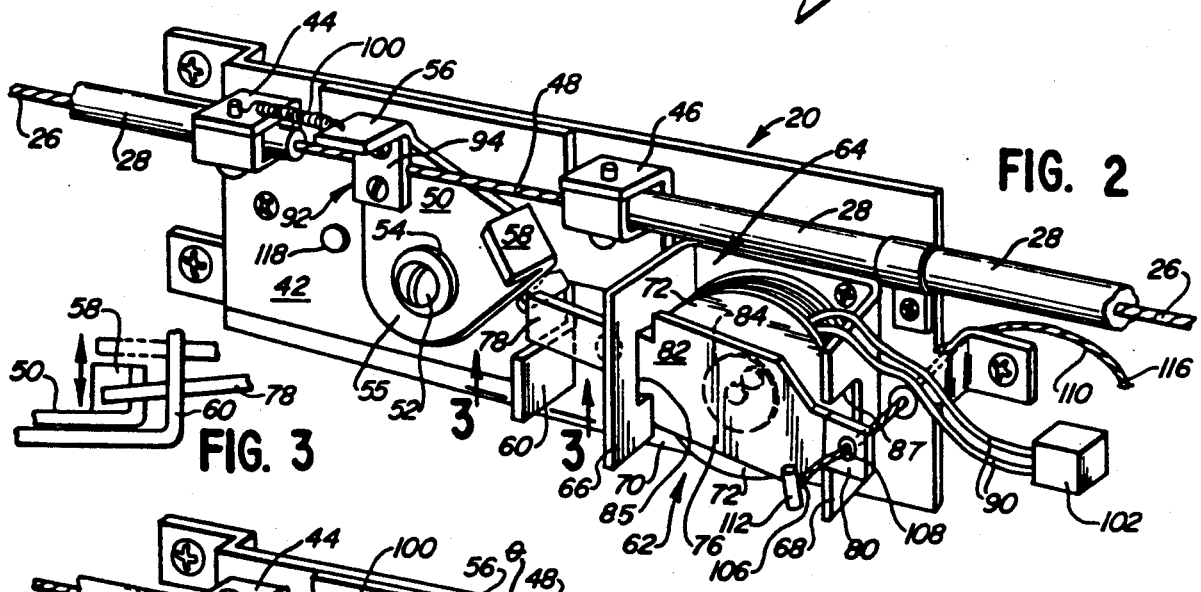
FIG. 2
FIG. 3
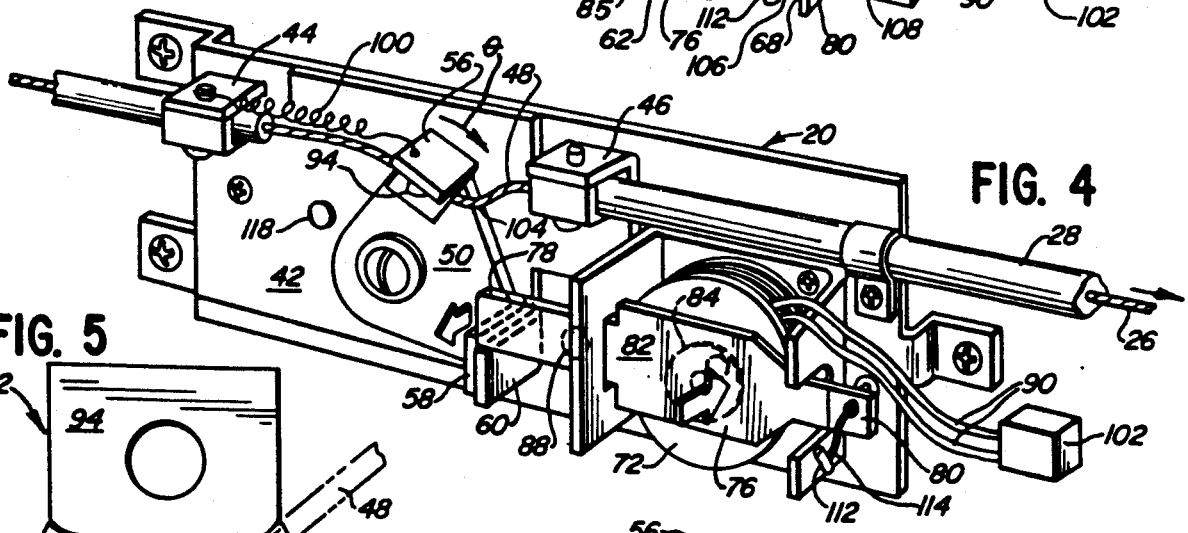
FIG. 4
FIG. 5
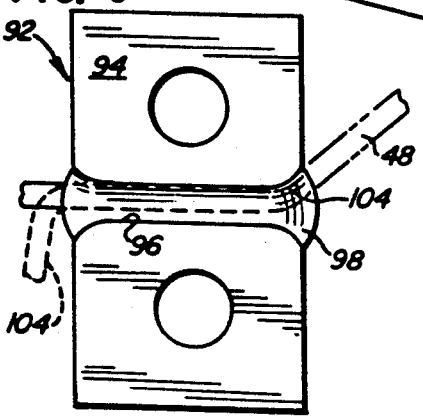
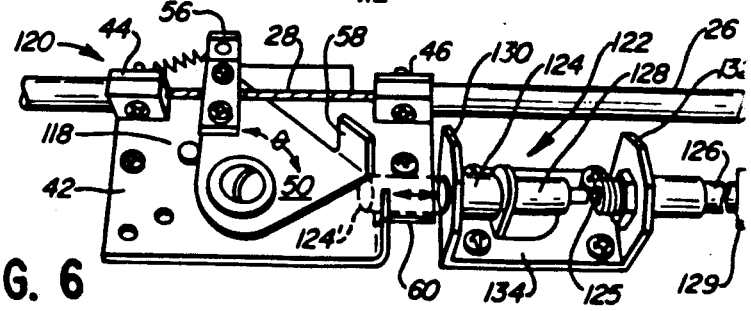
FIG. 6

ANTI-THEFT VEHICLE HOOD LOCK RELEASE BLOCKER MECHANISM

RELATED APPLICATION

This Application is a continuation-in-part of U.S. Pat. No. 037,210, filed Apr. 10, 1987 and entitled REMOTELY OPERATED HOOD RELEASE BLOCKER ASSEMBLY FOR A VEHICLE now U.S. Pat. No. 4,752,092, issued June 21, 1988

BACKGROUND OF THE INVENTION

1. Field of the Invention

This invention relates generally to hood locks for vehicles and more particularly, provides an improved antitheft vehicle hood lock release blocker assembly which is operable remotely from the interior of the vehicle in which it is installed. The assembly is constructed to effect release of the hood lock for opening the vehicle hood upon predetermined signals.

2. Description of the Prior Art

Vehicle theft prevention systems include components intended to provide protection and warnings against any unauthorized attempts to gain access to the vehicle for the purpose of theft, either of the vehicle or the contents of the interior thereof. Many types of visual and audible alarms are provided which are triggered by breaking windows, tampering with ignition systems or by causing the vehicle to be moved. Frequently used methods of stealing vehicles involve starting of the vehicle either by crossing of the ignition wires or by gaining access to the interior of the engine compartment and manipulating the ignition system therefrom.

Hood locks are customarily provided to assure that the normally spring biased hood will not accidently open during the operation of the vehicle. Such locks conventionally include a latch lever on the hood engaging a catch or keeper located in the interior of the engine compartment. The latch lever is spring biased to be normally engaged with the keeper. A cable is provided for disengaging the latch lever from the keeper. The cable is brought into the front passenger compartment through the firewall and dashboard of the vehicle, terminating in a handle. Manipulation of the handle, such as by pulling thereon, will cause the latch lever to be fully or partially disengaged from its keeper and the hood is either fully released or enabled for release by an operator from exterior of the vehicle. The conventional hood lock and the release apparatus have become a weak link in the chain of protection presently available against theft of the vehicle and/or various operating components located within the engine compartment.

It is desirable that additional precautions should be taken against theft. One precaution would be to prevent release of the hood lock by use of a positive hood lock release assembly, which assembly is operable only from within the passenger compartment, preferably with the use of a restricted distribution key or the like being required to enable the release assembly.

SUMMARY OF THE INVENTION

The invention provides a blocker assembly for a hood lock release for a vehicle, the assembly having apparatus operable to block release of the hood latch lock and electromechanical or mechanical apparatus to render the blocking apparatus ineffective to bar the release of the hood lock. Preferably, the mechanical or electromechanical apparatus are rendered effective by a key device operable remotely from the interior of the vehicle. The assembly of the invention includes a cable attachment apparatus for installation either as original equipment or for adaptation to conventional hood lock releases as an after-market or retrofit apparatus. Structure is also included for preventing undue wear to the conventional cable used to activate the hood lock release.

BRIEF DESCRIPTION OF THE DRAWING

FIG. 1 is a representation of the hood and front compartment of a vehicle having a hood lock release blocker assembly installed therein;

FIG. 2 is a perspective view of one embodiment of the hood lock release blocker assembly of the parent application U.S. Pat. No. 037,210;

FIG. 3 is a detailed sectional view taken along lines 3—3 of FIG. 2 in the direction indicated generally;

FIG. 4 is a perspective view of the hood lock release blocker assembly of FIG. 2 illustrating the condition thereof subsequent to operation of the release mechanism of the invention;

FIG. 5 is a bottom planar view of a detail of FIG. 4;

FIG. 6 is a reduced perspective view of a modified form of the blocker assembly of the parent application U.S. Pat. No. 037,210;

DESCRIPTION OF THE PREFERRED EMBODIMENTS

Figure 7:
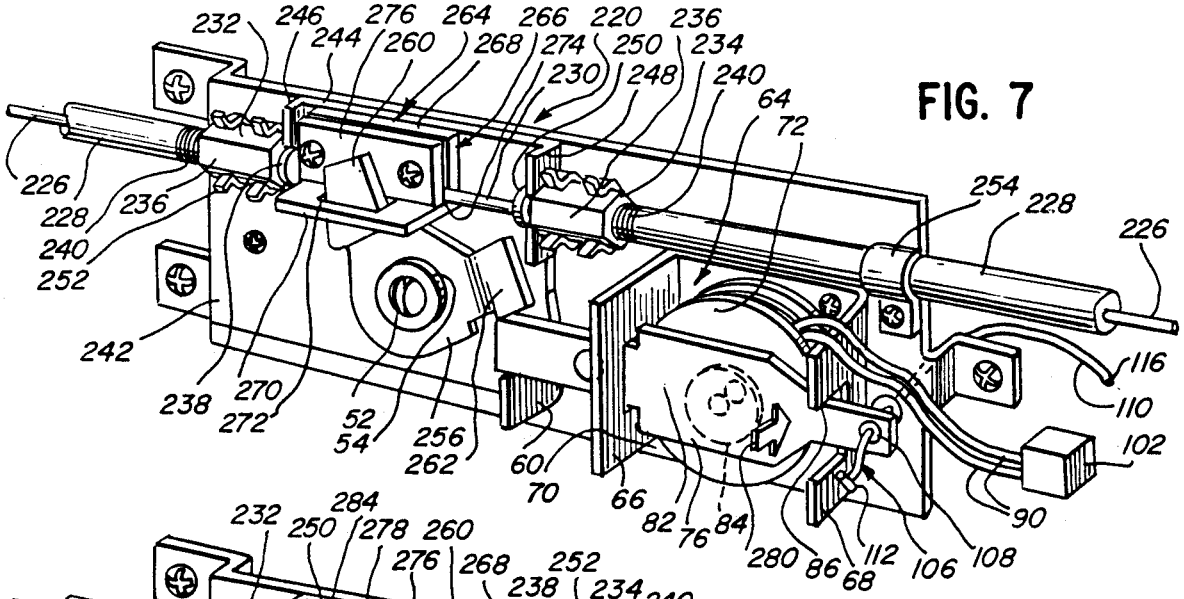
FIG. 7 is a perspective view of the hood lock release blocker assembly embodying the invention shown in the interferent or locked position.

Referring to the drawings, in FIG. 1 there is illustrated a diagrammatic representation of the forward section of a vehicle 10 showing a hood 12 in closed condition, a hood lock 14 installed within an engine compartment 16, a conventional hood lock release assembly 18 within the forward portion of the passenger section and a hood release blocker assembly 20 installed within the engine compartment 16 at a location intermediate the hood lock 14 and the conventional hood lock release assembly 18.

The hood lock 14 includes a pivotable latch 22 engaged with a keeper 24, the hood lock 14 usually being mounted at the forward portion of the engine compartment 16. The conventional hood lock release assembly 18 includes an elongate braided cable 26 within an outer sheath or cover 28. The cable 26 may also be provided as a flexible solid rod as depicted in FIGS. 7–10 of the present invention. One end 30 of the cable 26 is coupled to the latch 22 and an opposite end 32 is brought through the firewall 34 at the rear of the engine compartment 16 and secured to a handle 36 arranged on a bracket 38 so that the handle is accessible at the dash board 40. The handle 36 is adapted to be pulled to cause the latch 22 to swing out of engagement with the keeper 24 to release the hood 12.

The hood lock release blocker assembly 20 according to the parent application prevents the release of the hood 12 in the absence of a specific activity performed by the operator. The blocker assembly 20 is mounted at a preferred location within the engine compartment 16. The cable 26 is brought through the assembly 20 intermediate the hood latch 22 and the location at the firewall where the cable 26 is drawn through the firewall 34.

Referring to FIGS. 2–4, the blocker assembly 20 is illustrated disposed on its side for viewing convenience and includes a base plate 42 for mounting onto a selected portion of the vehicle within the engine compartment 16. A pair of guide clamps 44, 46 are positioned spaced apart along a length of the base plate 42. The cable 26 with its sheath 28 is secured in the respective clamps 44, 46 so that a bared portion 48 thereof (sheath removed) extends horizontally therebetween. A planar platform 50 having a generally triangular perimetric configuration is mounted to the base plate 42 by a bolt 52 and a washer 54 at a location adjacent the apex 55 so that it is journaled for rotation through an arc Θ. The platform 50 is provided with a pair of spaced upstanding flanges 56, 58 at the corners of the platform 50. An upstanding flange 60 is formed on the base plate 43 disposed perpendicular thereto and located at the termination of the arc Θ to limit the extent of rotation of said platform 50.

A housing 62 is mounted to the base plate 42 at a location adjacent the flange 60 and includes a U-shaped formation 64 and a cover (not shown) including a pair of spaced walls 66, 68 and a connecting base plate 70. The walls 66 and 68 are parallel one to the other and normal to the base plate 70. An electromagnetic wafer 72 is seated on the connecting base 70 between the walls 66 and 68 and normally covered by the cover (not shown). A thin elongate lever 76 is disposed across the electromagnetic wafer 72. The lever 76 has a pair of planar opposite narrow end portions 78, 80 and a larger midportion 82 disposed overlying the electromagnetic wafer 72 and connected thereto by a coil spring 84. The end portion 78 of the lever 76 extends through a slot or passage 85 formed in the wall 66 while the opposite end 80 of the lever 76 extends through a passage 87 formed in the wall 68 of the U-shaped formation 64. The passage 87 as shown is in the form of a notch opening to the top of the wall 68 and of size and configuration so that the movement of the lever end portion 80 up and down is not restricted. The end portion 78 extends into the path of the flange 58 at a location intermediate the full arc Θ of rotation of the plate 50. The end portion 78 of the lever 76 is tethered to the wall 66 of the formation 64 by a spring wire 88. An electrical lead 90 is secured to the electromagnetic wafer 72 and brought through the wall 68. The bared portion 48 of the cable 26 is secured tightly to the platform 50 by a clamp 92 at a location closely adjacent the flange 56. As shown in FIG. 5, a clamp plate 94 of the clamp 92 is provided with a shallow transverse groove 96 to accommodate the bared portion 48 of the cable 26. A pair of open ends 98 of the groove 96 are coined to define a smooth tapered entrance and/or exit respectively for the bared portion 48. When the clamp 92 is tightened, the cable portion 48 is incapable of being moved, although the cable 26 is movable relative to the sheath 28 surrounding same along the unbared remaining portions thereof.

Accordingly, pulling on the handle 36 of the hood release assembly 18 will cause the platform 50 to rotate along the full length of the arc Θ until such rotation is stopped by the upstanding flange 60. A return coil spring 100 is secured to the flange 56 and to the guide clamp 44 so that the platform 50 is automatically returned when the cable 26 is released. The full rotation of the platform 50 through the full angle Θ is required to enable the release of the latch 22 from the keeper 24. If the stop 58 is intercepted as it moves along the path following arc Θ, for example by the end portion 78 of the lever 76, and its travel is stopped short of the full angle Θ, release of the latch 22, and hence release of the hood 12 is prevented.

The end portion 78 of the lever 76 is brought into intercepting condition along the path of flange 58 by energization of the electromagnetic wafer 72. This can be effected by actuation of a switch 102 connected to the wafer 72 and to the electrical system of the vehicle, the switch 102 being mounted within the passenger section of the vehicle 10 and accessible to the operator. The switch 102 can be key controlled.

When the cable 26 is pulled, and since the bared portion 48 thereof cannot move, the platform 50 is rotated. The portion 48 is twisted into an "S" configuration when the platform 50 is rotated. During the course of operation, considerable strain and wear is borne by the curved sections 104 of the cable portion 48 as it is flexed. In the absence of the flared entrance and exits of the groove 96 the cable 26 could fray and become severed, substantially reducing the expected operating life of the assembly 20. Providing the smooth tapered open ends 98 of the groove 96 resulting from the coining earlier described at the entrance and/or exit of the groove 96 in which the bared portion 48 is fixed alleviates the otherwise relative sharp corners and hence reduces frictional wear on the bared cable portion 48.

It is advantageous to provide a release 106 for manually releasing the lever 76 should the lever jam or otherwise remain in its blocking condition when the electromagnetic wafer 72 is energized. In order to be effective, the manually operated release 106 provided for releasing the lever 76 from its blocking condition must not be readily visible or accessible to any "outsider". Therefore, for example, access to the manual release 106 for the blocker assembly 20 may be provided by forming an opening in the end portion 80 of lever 76 and threading a thin wire or braided cable 110 through the opening 108. A crossbar 112 or knot may be formed at the cable end 114. The opposite end 116 of the thin wire or braided cable 110 is permitted to hang free. The wire 110 is sufficiently long so that the end 116 can be grasped from the underside of the vehicle. The end portion 78 of the lever 76 can be raised out of the path interfering condition simply by pulling the wire end 116 in a downward direction. A stop button 118 is provided on the base plate 42 so that the platform plate 50 returns to its proper rest disposition under the force of spring return. Thus, the rotation of the platform is limited to the extent of the arc Θ.

Referring now to FIG. 6, a modified assembly embodiment of the parent application is illustrated and designated by a reference character 120. The assembly 120 is identical to the assembly 20 except for the substitution of a dead bolt mechanism 122 for the electromagnetic wafer 72, the mechanical operation thereof being in lieu of the electrical operation of the assembly 20. In place of the lever 76, a mechanical dead bolt 124 is employed, shown in withdrawn condition in full lines and in blocking condition in phantom line representation 124'. A rod 125 extends through a wall 130 and is sheathed at 126 to extend rearward from the dead bolt housing 128 and is coupled to a key-operated mechanism represented by a reference character 129 which can be located at the dashboard within the passenger section of the vehicle 10, the key operated mechanism 129 being provided in substitution for the switch 102 employed in the assembly 20.

The assembly 120 includes a pair of spaced upright walls 130 and 132 and a unitary connecting base 134 which is fastened to the base plate 42. A cover (not shown) is provided. The dead bolt 124 is disposed within the housing 128. When the dead bolt 124 is in the unlocked condition, it is withdrawn into the housing 128. When the dead bolt 124 is in the locked condition, as shown in phantom line representation 124', it extends outward of wall 130 into intercepting condition relative the flange 58 and will prevent rotation of the platform 50 to the full extent of the arc Θ. When the bolt 124 is withdrawn, full rotation is possible so that the hood can be released.

Figure 8:
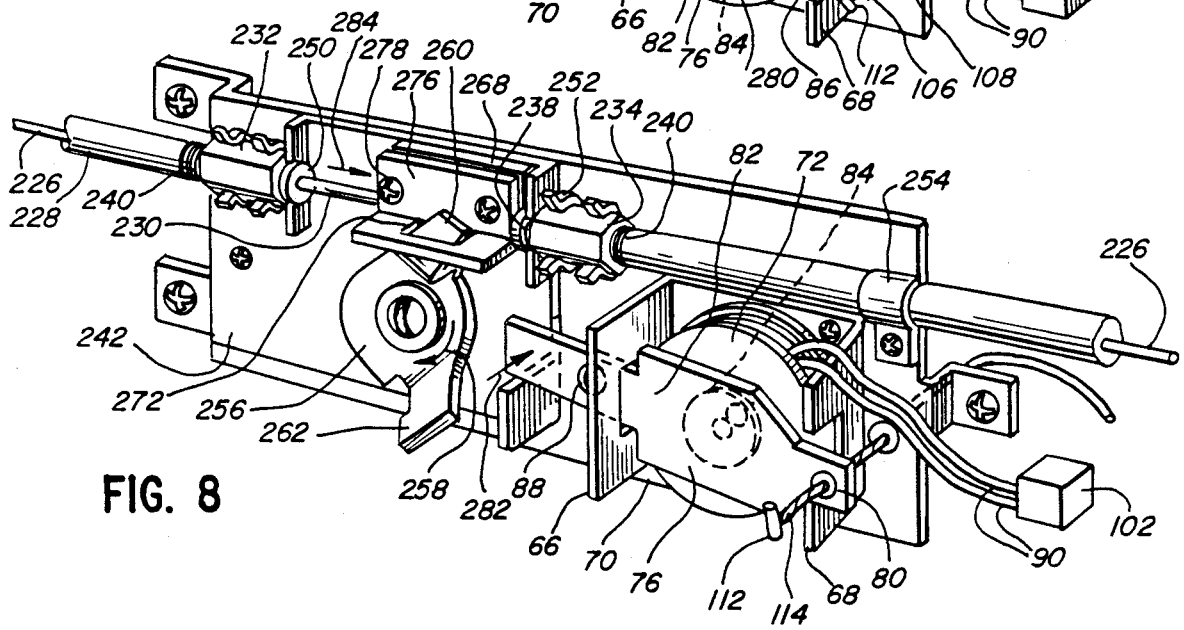
FIG. 8 is a perspective view of the hood lock release blocker assembly depicted in FIG. 7, shown in the release position.

Referring now to FIGS. 7 and 8, the hood lock release blocker assembly of the invention herein is illustrated, disposed on its side for viewing convenience and designated generally by a reference numeral 220. The assembly 220 utilizes many components in common with the assembly 20 illustrated in FIGS. 2–4, and these shared components retain the reference numerals previously allocated thereto.

The assembly 220 is designed to alleviate potential strain on the cable 26 from the operation of the assembly depicted in FIGS. 2–4 and indicated hereinabove. The assembly 220 is designed to be installed as original equipment on the vehicle 10, or as an after-market or retrofit assembly for conventional hood lock releases. As such, it is contemplated that the assembly 200 can be utilized with the conventional cable 26 and sheath 28, as illustrated in FIGS. 2, 4 and 6, wherein the cable 26 is shown braided. The assembly 200 also can be utilized with a flexible rod, or a retrofit type cable 226, with a sheath 228. The cable 226 is shown as a flexible rod but also can be a braided cable. The sheath 228 preferably is removed adjacent to the assembly 220, creating a bared portion 230 defined by a pair of conventional adjustable barrels 232, 234. Each barrel 232, 234 is provided with a plurality of peripheral facets 236 and an annular recess 238 located adjacent the bared portion 230. The barrels 232, 234 are each provided with an internal threaded axial bore (not shown) which engages a corresponding threaded portion 240 of the sheath 228 to adjust the length of the bared portion 230.

The assembly 220 includes a base plate 242 which is provided with a U-shaped cable retaining bracket 244. The bracket 244 is provided with a pair of upstanding walls 246 and 248, each having a cutout portion 250. Each of the cutout portions 250 is dimensioned to retain the annular recess 238 of the cable barrels 232, 234. The adjustability of the barrels 232, 234 enables the cable 226 to be accommodated by the brackets 244 of varying dimensions.

At least one spring clip 252 is secured to the base plate 242 adjacent each of the walls 246, 248. The spring clip 252 is located thereon to open in the same direction as does the cutout 250 to accept and clampingly engage the facets 236 of the barrels 232, 234. Two clips 252 are shown per barrel 232, 234, however the number and configuration of the clips 252 can vary according to the particular application. If desired, additional brackets 254 can be provided as necessary to securely retain the cable 226 to the assembly 220.

A planar platform 256 having a generally perimetric configuration somewhat similar to the platform 50 shown in FIGS. 2, 4, and 6, is mounted to the base plate 242 by a bolt 52 and washer 54 so that it is journaled for rotation through the arc indicated by the arrow 258. The platform 256 is provided with an 'L'-shaped cable connection flange 260 located at a first corner of the platform and projecting outwardly from the perimeter thereof, and an upwardly angled flange 262 located at a second corner of the platform 256.

The platform 256 is connected to the bared portion 230 of the cable 226 by a connector 264. The connector 264 includes an 'L'-shaped member 266 provided with a back wall 268, a slotted wall 270 with an elongate slot 272 dimensioned to accommodate the end of the 'L'-flange 260 and a crux 274. The connector 264 also includes a locking plate 276 which directly opposes the back wall 268 and is fastened thereto by at least one threaded fastener 278. The connector 264 is assembled so that the bared portion 230 is located in the crux 274 of the L-member 266 and is sandwiched between the opposing faces of the back wall 268 and the locking plate 276. The platform 256 is positioned so that the end of the flange 260 is inserted into the slot 272.

Referring to FIG. 7, the connector 264 is located on the bared portion 230 adjacent the barrel 232, and the narrow end 78 of the lever 76 is held in the interferent or locked condition, engaging the flange 262 and preventing any movement of the platform 256 in the direction 258, described in detail in relation to FIGS. 2–4 hereinabove. The flange 60 acts to support the lever end 78 against a force exerted by the upwardly angled flange 262 as it is rotated in the direction 258. The electromagnetic wafer 72 is energized to exert a force on the lever 76 represented by the arrow 280. In this position, the hood 12 is prevented from opening.

Referring to FIG. 8, when the electromagnetic wafer 72 is actuated to move the end 78 of the lever 76 in the direction indicated by the arrow 282, the assembly 220 is in the released or noninterferent condition, wherein the cable 226 and the connector 264 are moved in the direction indicated by the arrow 284 and the flange 262 then can pass the end 78 of the lever 76. This movement of the cable 226 is initiated by pulling on the handle 36 (shown in FIG. 1). In this condition, the hood latch 22 (shown in FIG. 1) is released.

Figure 9:
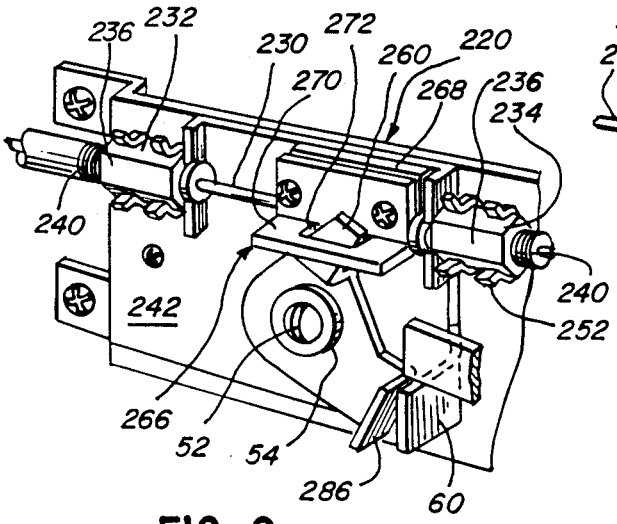
FIG. 9 is a fragmentary perspective view of a modified form of the hood lock release blocker assembly of the invention, shown in the locked or interferent position.
Figure 10:
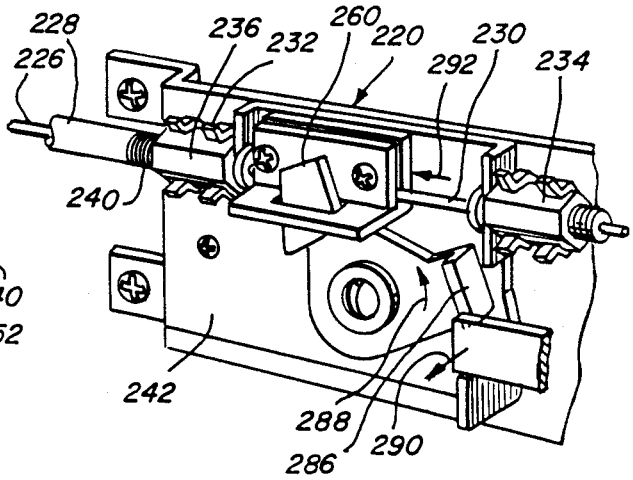
FIG. 10 is a fragmentary perspective view of the assembly depicted in FIG. 9, shown in the release position.

Referring now to FIGS. 9 and 10, an alternate embodiment to the blocking assembly 220 is depicted, indicated generally by reference numeral 220', in which the platform 256 has been modified, and the assembly 220' is designed for release of the hood lock by pushing the cable 226 instead of pulling it, as described hereinabove in relation to FIGS. 7 and 8. The platform 256 is substantially identical to the platform 256, with the exception that the angled flange 262 has been modified to an upstanding flange 286.

When the assembly 220' is in the interferent or locked position depicted in FIG. 9, the end 78 of the lever 72 is activated by the electromagnetic wafer 72 to engage the flange 286, preventing the cable 226 from moving. The cable connector 264 is shown positioned adjacent the cable barrel 234, in contrast to the arrangement depicted in FIG. 7.

Referring now to FIG. 10, when the electromagnetic wafer 72 (shown in FIG. 8) is energized to move the lever end 78 in the direction indicated by the arrow 290, the assembly 220' is in the released or noninterferent condition. The cable 226 is now free to be moved in the direction indicated by the arrow 292, which is accomplished by the driver of the vehicle pushing on the handle 36 (shown in FIG. 1).

The assembly 220, the cable 226 and/or the assembly 220' may be provided in a containerized kit form packaged in conventionally available materials and containers including, but not limited to boxes or bags made of paper, cardboard or plastic. This kit form may be provided to assist vehicle operators in the installation of the hood release mechanisms of the invention.

Many modifications and variations of the present invention are possible in light of the above teachings. Many variations in the size, configuration and arrangement of the individual components described herein can be effected by ones skilled in the art without departing from the spirit and scope of the invention as claimed in the appended claims. It is therefore, to be understood that within the scope of the appended claims, the invention may be practiced otherwise than as specifically described.

What is claimed and desired to be secured by Letters Patent of the United States is:

1. An anti-theft vehicle hood release blocker assembly for a vehicle having a hood latch and a sheathed cable secured thereto, said cable being manipulatable to release said latch, said assembly comprising:

a base plate mounted along a length of said cable;

a rotatable platform provided with cable engaging means and journaled on said base plate for rotation thereon between a first condition wherein said latch is locked and a second condition wherein said latch is released;

said cable engaging means including a connector flange fastened to and projecting from said platform to matingly engage a cable connector fastened to a bared portion of said length of said cable so that when said flange engages said connector, said platform moves in relation to said cable;

blocker means intermediate said locked condition and said released condition for preventing said platform from reaching said released condition, said blocker means including a blocker member disposed between a first condition interferent with the movement of said platform and a second condition permitting the movement of said platform to said release condition; and means operable upon said blocking member for selectively placing same in said first condition or said second condition.

2. The assembly defined in claim 1 wherein said cable connector includes an L-member with a back wall and a slotted wall, and a locking plate designed to fixedly sandwich said bared cable portion between opposing faces of said locking plate and said back wall.

3. The assembly defined in claim 2 wherein said flange of said platform matingly engages said slot of said slotted wall.

4. The assembly defined in claim 1 wherein said platform is provided with a second flange located in spaced relationship from said connector flange and projecting outwardly from said platform to engage said blocker member when said platform is in said locked condition.

5. The assembly defined in claim 4 wherein said second flange is L-shaped.

6. The assembly defined in claim 1 wherein said base plate is provided with clamping means to secure said cable sheath thereto.

7. The assembly defined in claim 6 wherein said clamping means include separate clamps designed to engage said cable sheath and located adjacent each end of said bared portion of said cable.

8. The assembly defined in claim 7 wherein said clamps include a U-shaped cable bracket provided with a pair of upstanding walls each wall provided with a cutout portion.

9. The assembly defined in claim 8 wherein said clamps further include at least one spring clip arranged to clampingly engage said cable sheath adjacent each of said upstanding walls.

10. The assembly defined in claim 1 wherein said bared portion cable is defined by a pair of sheath ends, each sheath end provided with an adjustable barrel.

11. The assembly defined in claim 10 wherein said base plate is provided with clamp means to secure said adjustable barrels thereto.

12. The assembly defined in claim 11 wherein said clamps include a U-shaped cable bracket provided with a pair of upstanding walls.

13. The assembly defined in claim 12 wherein said clamps further include at least one spring clip arranged to clampingly engage said cable sheath adjacent each of said upstanding walls.

14. The assembly defined in claim 1 wherein said latch is released by pulling said cable from within said vehicle.

15. The assembly defined in claim 1 wherein said latch is released by pushing said cable from within said vehicle.

16. An anti-theft vehicle hood release blocker assembly for a vehicle having a hood latch and a sheathed cable secured thereto, said cable being manipulatable to release said latch, said assembly comprising:

a base plate mounted along a length of said cable;

a rotatable platform provided with cable engaging means and journaled on said base plate for rotation thereon, between a first condition wherein said latch is locked and a second condition wherein said latch is released;

said cable engaging means including a connector flange fastened to and projecting from said platform to matingly engage a cable connector fastened to a bared portion of said length of said cable so that when said flange engages said connector, said platform moves in relation to said cable;

said cable connector including an L-member with a back wall, a slotted wall dimensioned to matingly engage said connector flange and a crux, and a locking plate designed to fixedly sandwich said cable in said crux between opposing faces of said locking plate and said back wall;

blocker means intermediate said locked condition and said released condition for preventing said platform from reaching said released condition and including a blocker member disposed between a first condition interferent with the movement of said platform and a second condition permitting the movement of said platform to said release condition;

a second flange located in spaced relationship from said connector flange and projecting from said platform to engage said blocker member when said platform is in said locked condition; and means operable upon said blocking member for selectively placing same in said first condition or said second condition.

17. The assembly defined in claim 16 wherein said base plate is provided with clamping means to secure said cable sheath thereto, said clamping means including separate clamps designed to engage said cable sheath and located adjacent each end of said bared portion of said cable.

18. The assembly defined in claim 17 wherein said clamps include a U-shaped cable bracket provided with a pair of upstanding walls.

19. The assembly defined in claim 18 wherein said clamps further include at least one spring clip arranged to charmingly engage said cable sheath adjacent each of said upstanding walls.

20. A containerized kit for installing an anti-theft vehicle hood release blocker in a vehicle, said kit comprising:

at least one hood release blocker assembly; and a sheathed cable provided with a portion bared of said sheath for engagement with said assembly.

* * * * *